US006998781B2

(12) United States Patent
Kimura et al.

(10) Patent No.: US 6,998,781 B2
(45) **Date of Patent: *Feb. 14, 2006**

(54) PLASMA DISPLAY DEVICE HAVING BARRIER RIBS

(75) Inventors: Tomohiro Kimura, Tokyo (JP); Eitaro Yoshikawa, Kanagawa (JP); Hiroshi Mori, Kanagawa (JP)

(73) Assignee: Sony Corporation, (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/102,750

(22) Filed: Apr. 11, 2005

(65) Prior Publication Data

US 2005/0174055 A1 Aug. 11, 2005

Related U.S. Application Data

(63) Continuation of application No. 10/415,410, filed as application No. PCT/JP02/09105 on Sep. 6, 2002.

(30) Foreign Application Priority Data

Sep. 7, 2001 (JP) ..... 2001-271783
Jun. 20, 2002 (JP) ..... 2002-179274

(51) Int. Cl.
*H01J 17/49* (2006.01)

(52) U.S. Cl. ..... 313/582; 313/292

(58) Field of Classification Search ..... 313/582, 313/584, 586, 238, 252, 292
See application file for complete search history.

(56) References Cited

U.S. PATENT DOCUMENTS

| | | | | |
|---|---|---|---|---|
| 5,541,479 | A | 7/1996 | Nagakubo | |
| 5,661,500 | A | 8/1997 | Shinoda et al. | |
| 5,825,128 | A * | 10/1998 | Betsui et al. | 313/582 |
| 2002/0003405 | A1 | 1/2002 | Kang | |

FOREIGN PATENT DOCUMENTS

| | | | |
|---|---|---|---|
| JP | 5-166467 | A1 | 7/1993 |
| JP | 6-44907 | A1 | 2/1994 |
| JP | 11-007126 | | 12/1999 |
| JP | 2001-18933 | A1 | 1/2001 |
| JP | 2001-35392 | A1 | 2/2001 |
| JP | 2001-68027 | A1 | 3/2001 |
| JP | 2001-126622 | A1 | 5/2001 |
| JP | 2001-155644 | | 8/2001 |

* cited by examiner

*Primary Examiner*—Vip Patel
(74) *Attorney, Agent, or Firm*—Rader Fishman & Grauer PLLC; Ronald P. Kananen

(57) ABSTRACT

A plasma display device disclosed herein is capable of enhancing the contrast of external light, facilitating application of phosphor paste on the bottom of each space surrounded by lattice-like barrier ribs, and reducing a variation in the amount of the phosphor paste applied as much as possible. The lattice-like barrier ribs include lateral ribs extending along a first direction while being nearly in parallel to each other, and vertical ribs extending along a second direction different from the first direction while being nearly in parallel to each other. Each of the lateral ribs is composed of two or more rows of rib elements. Notches for communicating spaces surrounded by the vertical ribs and the lateral ribs to each other in the first direction and/or the second direction are formed at least in portions of the vertical ribs and/or the lateral ribs.

16 Claims, 9 Drawing Sheets

PLASMA DISPLAY DEVICE HAVING BARRIER RIBS

This is a continuation application of Ser. No. 10/415,410, filed on Apr. 29, 2003, which is a 371 of PCT/JP02/09105, filed Sep. 6, 2002, the entire contents of which are hereby incorporated by reference.

TECHNICAL FIELD

The present invention relates to a plasma display device and particularly to the structure of barrier ribs for partitioning discharge spaces from each other in a plasma display device.

BACKGROUND ART

Flat panel type display devices have been variously examined as image display devices to be replaced from the existing mainstream cathode ray tubes (CRTs). Such flat panel type display devices include liquid crystal display devices (LCDs), electroluminescence display devices (ELDs), and plasma display devices (PDPs: Plasma Displays). In particular, the plasma display devices are expected to be applied to domestic wall-hung televisions, public large-sized information terminal devices, and the like because of advantages in relatively easily obtaining large screens and wide viewing angles, enhancing the resistance against environmental factors such as temperature, magnetism, and vibration, prolonging the service life, and the like.

The plasma display device emits light by applying a voltage in discharge cells composed of discharge spaces filled with a discharge gas such as an inert gas, to generate ultraviolet rays due to glow discharge in the discharge gas, thereby exciting phosphor layers in the discharge cells with the ultraviolet rays. In this way, the individual discharge cells are driven on a principle similar to that of fluorescent lamps, and these discharge cells of the number of several hundreds of thousand are collected to form one display screen. The plasma display device is mainly classified into a direct current driven type (DC type) and an alternating current driven type (AC type) from the viewpoint of the type of applying a voltage to discharge cells. The DC type and AC type plasma display devices each have some drawback and advantage.

The AC type plasma display device is suitable for high definition because barrier ribs for partitioning individual discharge cells from each other within the display screen are sufficient to be formed into, for example, stripe shapes, and is also advantageous in that since surfaces of electrodes for discharge are covered with a dielectric layer, the electrodes are less worn, to thereby prolong the service life.

To improve the contrast of a display screen of a plasma display device, there is known a technique of coloring barrier ribs into black, as disclosed, for example, in Japanese Patent Laid-open Nos. 2001-155644 and Hei 11-7126.

As a result of examination of the present inventors, it has become apparent that the contrast cannot be sufficiently improved only by coloring barrier ribs into black. To solve such a problem, the present inventors have found that the contrast of a display screen of a plasma display device can be improved by providing a configuration that a barrier rib is composed of a vertical rib and a lateral rib, wherein the lateral rib is composed of two or more rows of lateral rib elements, and have previously filed the application based on such knowledge (see Japanese Patent Application No. 2001-245909).

The barrier rib structure having the lateral and vertical ribs, which is formed into a so-called waffle shape, however, has the following production problem: namely, the waffle shaped barrier ribs are disadvantageous in making it difficult to drop phosphor paste on the bottom of each space surrounded by the barrier ribs in the printing step, thereby tending to cause a variation in applied amount of the phosphor material.

In view of the foregoing, the present invention has been made, and an object of the present invention is to provide a plasma display device capable of enhancing the contrast of external light, facilitating printing performed by dropping phosphor paste on the bottom of each space surrounded by lattice-like barrier ribs, and reducing a variation in applied amount of the phosphor paste as much as possible.

DISCLOSURE OF INVENTION

To achieve the above object, according to the present invention, a plasma display device is provided including:

a plurality of pairs of discharge sustain electrodes formed on the inner side of a first substrate in such a manner as to extend along a first direction while being nearly in parallel to each other;

a dielectric layer formed on the inner side of the first substrate in such a manner as to cover the discharge sustain electrodes; and barrier ribs formed on the inner side of a second substrate in such a manner as to form discharge spaces sealed between the first substrate and the second substrate;

wherein the barrier ribs have vertical ribs extending along a second direction different from the first direction while being nearly in parallel to each other, and lateral ribs extending along the first direction while being nearly in parallel to each other;

notches for communicating spaces surrounded by the vertical ribs and the lateral ribs to each other along the first direction and/or the second direction are formed at least in portions of the vertical ribs and/or the lateral ribs; and each of the lateral ribs is composed of two or more rows of lateral rib elements.

Preferably, the width of each of the lateral rib elements is in a range of about 0.5 to 1.5 times of the width of the vertical rib.

Preferably, a reflection preventing groove is formed between the adjacent lateral rib elements.

According to the present invention, since each of the lateral ribs is composed of two or more rows of the lateral rib elements (which lateral rib is called "multi-row rib"), the contrast can be improved as compared with the related art plasma display device configured such that each of the vertical rib and the lateral rib is composed of one row of rib element. Such function and effect can be found only by the present inventors. Also, since the reflection preventing groove is formed between the lateral rib elements, external light having entered in the reflection preventing groove less emerges out of a display screen, thereby further improving the contrast of external light.

The lateral ribs configured as the multi-row ribs exhibit a secondary effect of improving the strength of the entire pattern of the barrier ribs. Since the discharge spaces are kept at a high degree of vacuum, the increased strength of the barrier ribs is more advantageous in keeping a uniform thickness of each discharge space.

According to the present invention, the notches for communicating the spaces surrounded by the vertical ribs and the lateral ribs to each other along the first direction and/or the second direction are formed at least in portions of the vertical ribs and/or lateral ribs. As a result, during production, phosphor paste dropped on the bottom of the space surrounded by the barrier ribs can be moved between the barrier ribs through the notches. As a result, it is possible to facilitate printing performed by dropping the phosphor paste on the bottom of the space surrounded by the barrier ribs, and hence to reduce a variation in applied amount of phosphor as much as possible. The formation of the notches in the ribs facilitates evacuation of the discharge spaces, and also facilitates the filling of the discharge spaces with the discharge gas.

According to the present invention, since the margin of a development condition at the time of forming the barrier ribs is increased, the pattern of the barrier ribs can be made fine. Since the margin at the time of sand blasting is increased, the cracking of the barrier ribs can be reduced, to improve the quality. Since the existing production process can be used only by changing various mask patterns, the production cost is not increased.

Preferably, the notch is formed in each of the two or more rows of the lateral rib elements of the lateral rib. The phosphor pattern of the same color generally extends along the second direction. Accordingly, the formation of the notch in each of the two or more rows of the lateral rib elements of the lateral rib is advantageous in facilitating the flow of phosphor paint of the same color along the second direction.

Preferably, the notches formed in the lateral rib elements adjacent to each other are located at positions where the notches are not continuous to each other but are offset from each other as seen along the second direction. With this configuration, it is possible to ensure the flowability of phosphor paste while preventing crosstalks between the discharge spaces along the second direction.

Preferably, the width of the notch in the first direction is in a range of ½ to 1 time the width of the vertical rib of the barrier rib. Such a size of the notch is preferable in increasing the effect of the present invention.

Preferably, the lateral rib is located at a position corresponding to a between-pixel gap present between one pair of the discharge sustain electrodes of one pixel and another pair of the discharge sustain electrodes of the adjacent pixel.

The between-pixel gap is a portion not contributing to light emission in the discharge space, and therefore, the disposition of the lateral rib in this gap is preferable in preventing crosstalks without reduction of brightness.

Preferably, at least the top of the barrier rib has a black color or a color similar thereto. Of course, the whole barrier rib may have a black color or a color similar thereto. With this configuration, the contrast can be further improved.

Preferably, the plasma display device according to the present invention includes address electrodes formed on the surface of the second substrate in such a manner as to extend along the second direction while being nearly in parallel to each other; and an insulating film formed on the surface of the second substrate in such a manner as to cover the address electrodes, the insulating film having a black color or a color similar thereto; wherein the barrier ribs are formed on the surface of the insulating film. With this configuration, the contrast can be further improved.

According to the present invention, the notches may be provided in the vertical rib. With this configuration since the notches are formed in the vertical rib and any notch is not formed in the lateral rib configured as the multi-row rib, it is possible to improve the contrast while ensuring the flowability of phosphor paste.

The wording "the ribs formed in such a manner as to extend along the direction while being nearly parallel to each other" used herein means that the ribs are not necessarily formed in such a manner as to extend in a straight-line shape but may be formed in such a manner as to extend in a meandering shape or a zigzag shape, or any other suitable shape; the ribs are not necessarily formed in such a manner as to be continuous to each other but may be formed in such a manner as to be discontinuous from each other; and the ribs may contain portions being not necessarily in parallel to each other.

For example, the vertical ribs may be formed in such a manner as to extend in a meandering shape or a zigzag shape (or any other suitable shape), and a discharge space be disposed between the adjacent vertical ribs in such a manner as to extend in a zigzag shape along both the first direction and the second direction.

The lateral rib may be formed at a position where the adjacent vertical ribs become closest to each other.

That is to say, the present invention may be applied to the related art special structure such as a meandering structure, a waffle structure, or any other structure having vertical ribs extending not in straight line. As a result, the discharge space formed into a polygonal or an elliptic shape (or any other suitable shape) surrounded by the lateral ribs and the vertical ribs extends in a zigzag shape along both the first direction and the second direction.

In the case of applying the structure (often called "double-waffle"structure) of the present invention to such a special rib structure, it is possible to further improve the strength of the barrier ribs and to further reduce crosstalks in the vertical direction and noise.

In the double waffle structure, since the reflection preventing groove is formed between the lateral rib elements, the contrast can be further improved. Also, in the waffle structure of the present invention, the reflection of external light can be reduced.

As described above, according to the present invention, it is possible to provide a plasma display device capable of improving the contrast of a display screen, facilitating printing performed by dropping phosphor paste on the bottom of a space surrounded by barrier ribs, and reducing a variation of applied amount of phosphor, with a relatively simple configuration.

BEST MODE FOR CARRYING OUT THE INVENTION

Figure 1:
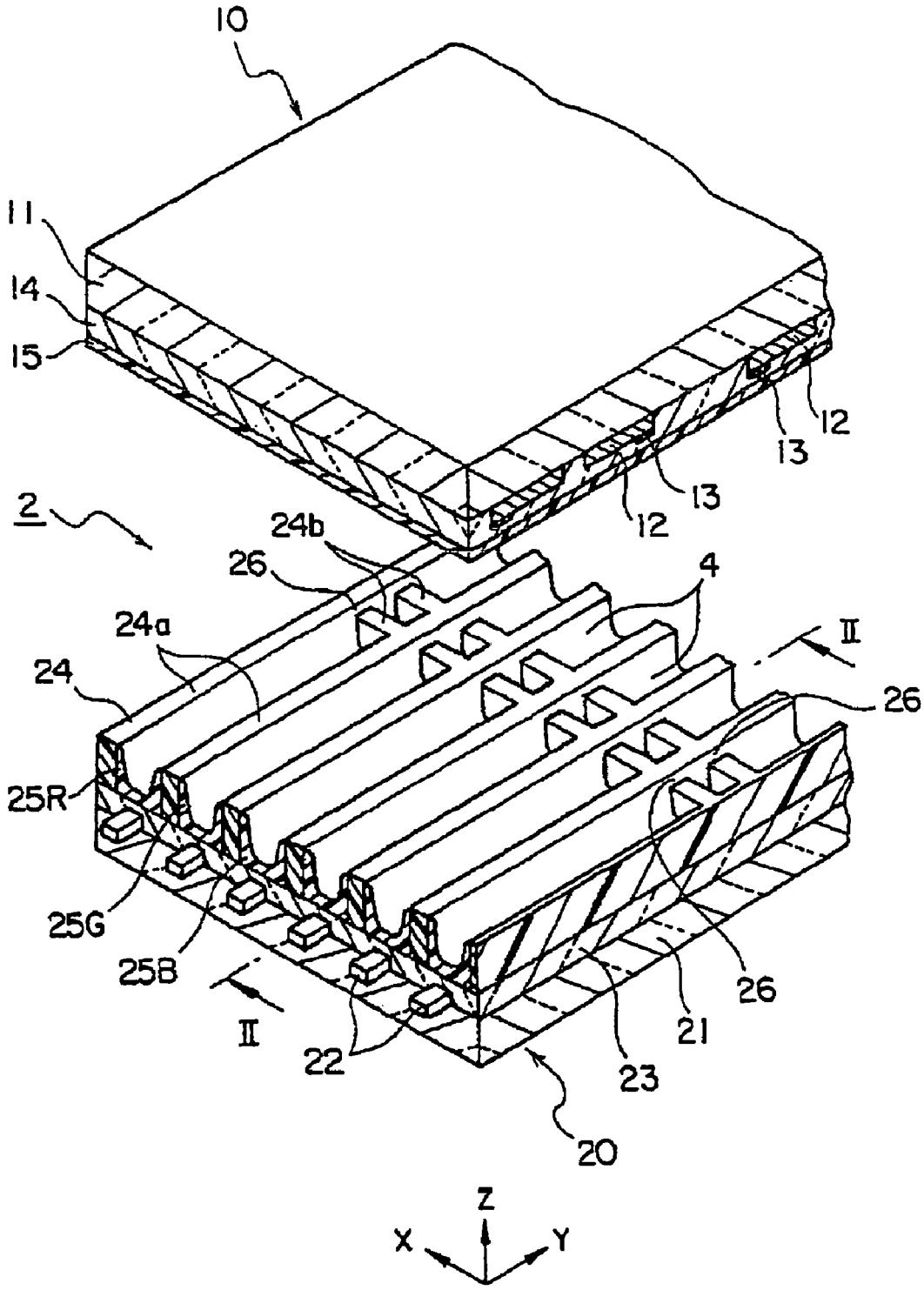
FIG. 1 is a schematic exploded perspective view of an essential portion of a plasma display device according to one embodiment of the present invention.

The present invention will be hereinafter described on the basis of embodiments shown in the drawings.

Figure 2:
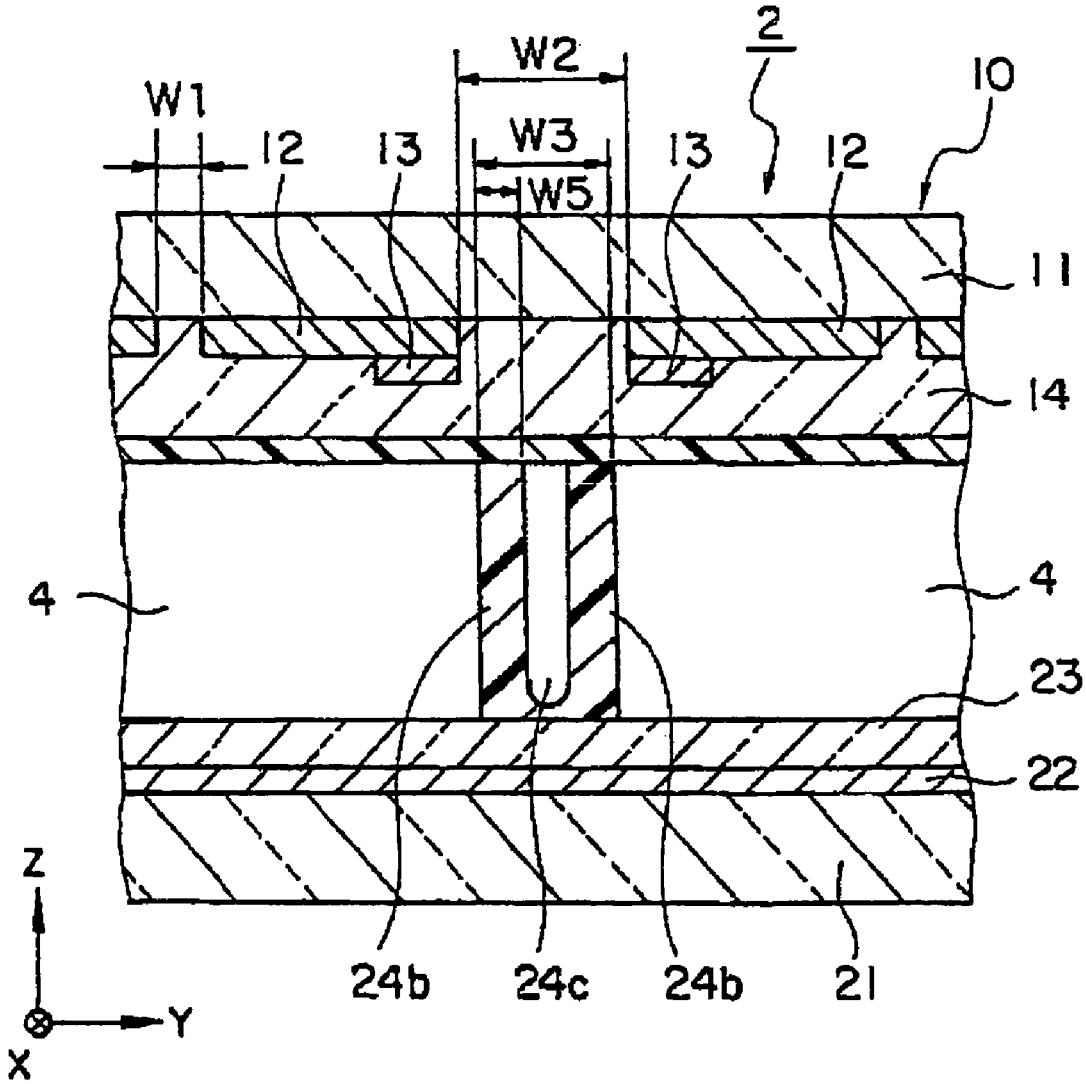
FIG. 2 is an enlarged sectional view taken on line II—II of FIG. 1.
Figure 3:
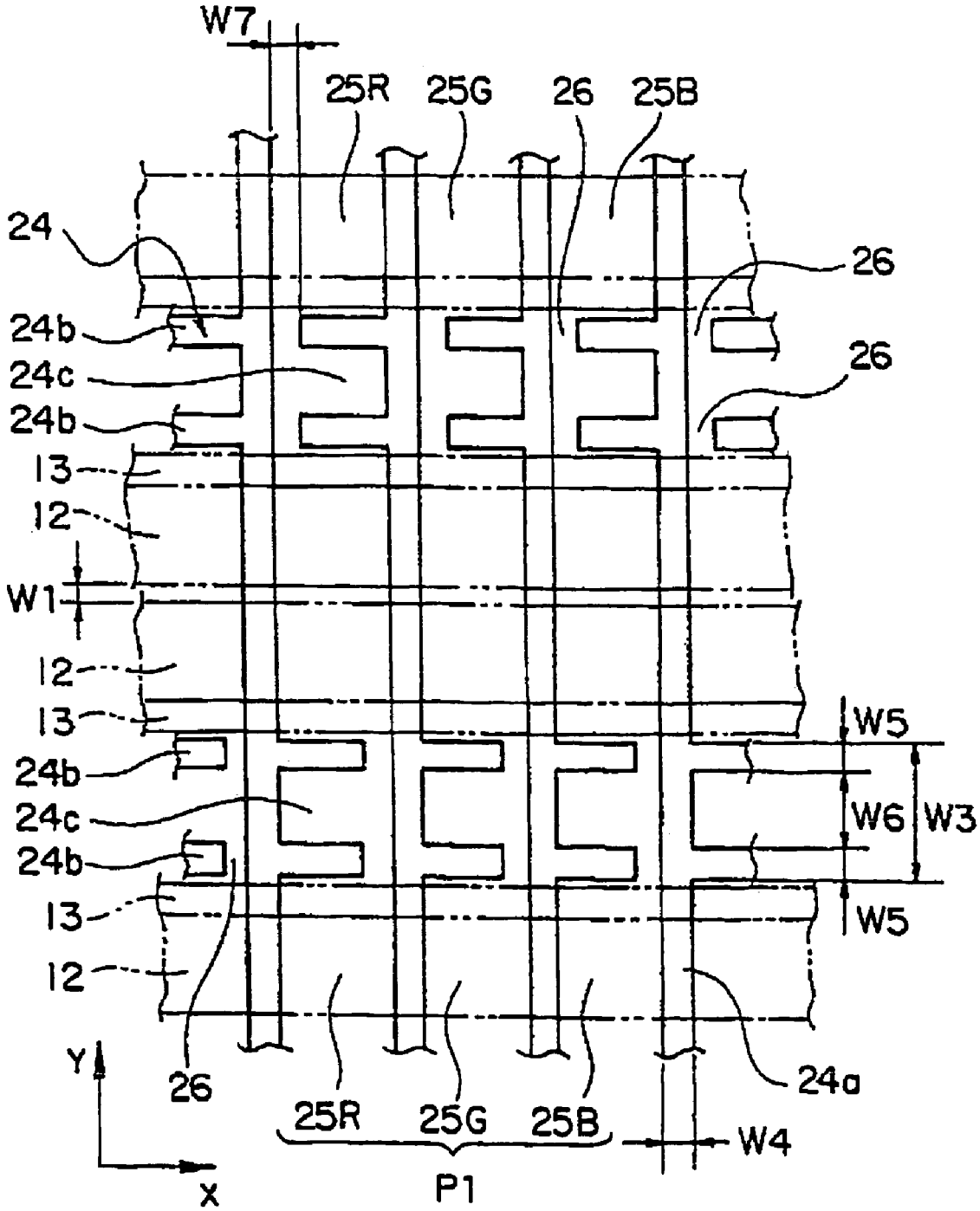
FIG. 3 is a plan view showing a relationship between discharge sustain electrodes and a pattern of barrier ribs.

FIG. 1 is a schematic exploded perspective view of an essential portion of a plasma display device according to one embodiment of the present invention; FIG. 2 is an enlarged sectional view taken on line II—II of FIG. 1; FIG. 3 is a plan view showing a relationship between discharge sustain electrodes and a pattern of barrier ribs; and FIGS. 4 to 9 are plan views showing patterns of barrier ribs according to other embodiments of the present invention.

(First Embodiment)

[Entire Configuration of Plasma Display Device]

First, the entire configuration of an alternating current driven type (AC type) plasma display device (hereinafter often referred to simply as "plasma display device") will be described with reference to FIG. 1.

An AC type plasma display device 2 shown in FIG. 1 is a so-called three-electrode type in which discharge occurs between each pair of discharge sustain electrodes 12. The AC type plasma display device 2 is formed by sticking a first panel 10 equivalent to a front panel to a second panel 20 equivalent to a rear panel. Light emitted from phosphor layers 25R, 25G, and 25B on the second panel 20 is observable, for example, through the first panel 10. In this case, the first panel 10 is taken as a display screen side.

The first panel 10 includes a transparent first substrate 11, a plurality of pairs of the discharge sustain electrodes 12, bus electrodes 13, a dielectric layer 14, and a protective layer 15. The discharge sustain electrodes 12 are formed on the first substrate 11 into stripe shapes extending in a first direction X while being nearly in parallel to each other, and are made from a transparent conductive material. The bus electrodes 13 are provided to lower impedances of the discharge sustain electrodes 12, and are made from a material having an electric resistivity lower than that of the discharge sustain electrodes 12. The dielectric layer 14 is formed on the first substrate 11 in such a manner as to cover the bus electrodes 13 and the discharge sustain electrodes 12. The protective layer 15 is formed on the dielectric layer 14. It is to be noted that the protective layer 15 is not necessarily formed but is preferably formed.

The second panel 20 includes a second substrate 21, a plurality of address electrodes (sometimes called "data electrodes") 22, an insulating film 23, insulating barrier ribs 24, and phosphor layers. The address electrodes 22 are formed on the second substrate 21 into stripe shapes extending in a second direction Y (approximately perpendicular to the first direction X) while being nearly in parallel to each other. The insulating film 23 is formed on the second substrate 21 in such a manner as to cover the address electrodes 22. The insulating barrier ribs 24 are formed on the insulating film 23. The phosphor layers are provided on the insulating film 23 in such a manner as to cover side wall surfaces of the barrier ribs 24. The phosphor layers are composed of red phosphor layers 25R, green phosphor layers 25G, and blue phosphor layers 25B.

FIG. 1 is the exposed perspective view showing only part of the display device, and in actual, as shown in FIG. 2, tops of the barrier ribs 24 on the second panel 20 side are in contact with the protective layer 15 on the first panel 10 side in a third direction Z (perpendicular to the first direction X and the second direction Y). A region in which one pair of the discharge sustain electrodes 12 with a discharge gap W1 put therebetween (see FIGS. 2 and 3) are overlapped to one address electrode 22 is equivalent to a single discharge cell. Discharge spaces 4, which are surrounded by the barrier ribs 24 covered with the phosphor layers 25R, 25G, and 25B and the protective layer 15, are filled with a discharge gas. A peripheral portion of the first panel 10 is joined to that of the second panel 20 by using frit glass.

The discharge gas, with which the discharge spaces 4 are to be filled, is not limited but is generally exemplified by an inert gas such as xenon (Xe) gas, neon (Ne) gas, helium (He) gas, argon (Ar) gas, nitrogen ($N_2$) gas, or a mixed gas thereof. The total pressure of the discharge gas in the discharge spaces 4 is not particularly limited but is generally in a range of about $6\times10^3$ Pa to $8\times10^4$ Pa.

The direction in which the discharge sustain electrodes 12 are projected is nearly perpendicular to (not necessarily perpendicular to) the direction in which the address electrodes 22 are projected. As shown in FIG. 3, a region in which one pair of the discharge sustain electrodes 12 with the discharge gap W1 put therebetween are overlapped to one set of the phosphor layers 25R, 25G, and 25B for emitting light of three primary colors is equivalent to one pixel P1. Since glow discharge is generated in a space (equivalent to the discharge gap W1) between each pair of the discharge sustain electrodes 12, the plasma display device of this type is called "surface discharge type". The method of driving this plasma display device will be described later.

The plasma display device in this embodiment is of a so-called reflection type in which light emitted from the phosphor layers 25R, 25G, and 25B is observable through the first panel 10. Accordingly, the conductive material for forming the address electrodes 22 may be either transparent or non-transparent, whereas the conductive material for forming the discharge sustain electrodes 12 must be transparent. The terms "transparent" and "non-transparent" used herein are based on light transparency of a conductive material for light having an emission wavelength (in a visible region) inherent to a phosphor layer material. In other words, if a conductive material is transparent for light emitted from a phosphor layer, such a conductive material is regarded as a transparent conductive material usable for forming the discharge sustain electrodes and address electrodes.

Examples of the non-transparent conductive materials used herein include Ni, Al, Au, Ag, Pd/Ag, Cr, Ta, Cu, Ba, $LaB_6$, and $Ca_{0.2}La_{0.8}CrO_3$. These materials may be used singly or in combination. Examples of transparent conductive materials used herein include ITO (Indium Tin Oxide) and $SnO_2$. The discharge sustain electrodes 12 or address electrodes 22 can be formed by forming an electrode layer by a sputtering process, a vapor-deposition process, a screen printing process, or a plating process, and patterning the electrode layer into electrodes by a photolithography process, a sandblasting process, or a lift-off process. The width of the discharge sustain electrode 12 is not particularly limited but is generally in a range of about 200 to 400 $\mu$m. The discharge width W1 between one pair of the discharge sustain electrodes 12 is not particularly limited but is generally in a range of about 5 to 150 $\mu$m. The width of the address electrode 22 is, for example, in a range of about 50 to 100 $\mu$m.

The bus electrode 13 is typically configured as a single-layer metal film made from a metal material such as Ag, Au, Al, Ni, Cu, Mo, or Cr, or a multi-layer film made from Cr/Cu/Cr or the like. In the reflection type plasma display device, the bus electrode 13 made from such a metal material may reduce an amount of visible light which has been emitted from a phosphor layer and which passes through the first substrate 11, thereby lowering brightness of a display screen, and from this viewpoint, the width of the bus electrode 13 is preferably made as thin as possible within such a region as to allow the bus electrode 13 to ensure an electric resistance required for the whole discharge sustain electrode. To be more specific, the width of the bus electrode 13 is smaller than the width of the discharge sustain electrode 12 and is, for example, in a range of about 30 to 200 $\mu$m. The bus electrodes 13 can be formed in the same manner as that used for forming the discharge sustain electrodes 12 and the like.

The bus electrode 13 is generally formed not on one end, on the discharge gap W1 side, of each of one pair of the discharge sustain electrodes 12 but, as shown in FIG. 3, on the other end, on the between-pixel gap (between the adjacent pixels P1 in the second direction Y) side, of the discharge sustain electrode 12 in such a manner as to be connected to the other end of the discharge sustain electrode 12 while extending along the longitudinal direction thereof. It may be considered that brightness of display light in the discharge space 4 is highest at a position in the discharge gap W1 between the discharge sustain electrodes 12, and therefore, if the bus electrode 13 having a shielding property is located in the vicinity of such a position, brightness becomes lower as a whole. Accordingly, the bus electrode 13 is located at the above-described position.

The dielectric layer 14 formed on the surfaces of the discharge electrodes 12 is formed of a single layer made from, for example, silicon oxide but may be formed of a multi-layer film. The dielectric layer 14 made from silicon oxide can be formed in accordance with an electron beam vapor-deposition process, a sputtering process, a vapor-deposition, a screen printing process, or the like. The thickness of the dielectric layer 14 is not particular, but in this embodiment, is in a range of 1 to 10 $\mu$m.

The effect of providing the dielectric layer 14 is to prevent direct contact of ions or electrons generated in the discharge spaces 4 with the discharge sustain electrodes 12. This makes it possible to prevent wear of the discharge sustain electrodes 12. The dielectric layer 14 has a memory function of storing wall electric charges generated during addressing, thereby sustaining the discharge state, and a function as a resistor for limiting occurrence of an excess discharge current.

The protective layer 15 formed on the surface, on the discharge space side, of the dielectric layer 14 functions to protect the dielectric layer 14 and thereby prevent direct contact of ions or electrons with the discharge sustain electrodes 12. As a result, the protective layer 15 can effectively prevent wear of the discharge sustain electrodes 12 and the dielectric layer 14. The protective layer 15 also functions to emit secondary electrons required for discharge. Examples of materials for forming the protective layer 15 include magnesium oxide (MgO), magnesium fluoride ($MgF_2$), and calcium fluoride ($CaF_2$). In particular, magnesium oxide is preferable because of its characteristics having a chemical stability, a low sputtering ratio, a high light transparency for light having an emission wavelength emitted from a phosphor layer, and a low discharge start voltage. The protective layer 15 may be formed of a multi-layer film made from at least two kinds selected from a group consisting of these materials.

Examples of materials for forming the first substrate 11 and the second substrate 21 include high strain point glass, soda glass ($Na_2.CaO.SiO_2$) borosilicon glass ($Na_2O.B_2O_3.SiO_2$), forsterite ($2MgO.\ SiO_2$), lead glass ($Na_2O.PbO.SiO_2$). The materials of the first substrate 11 and the second substrate 21 may be identical to or different from each other; however, they preferably have the same thermal expansion coefficient.

The phosphor layers 25R, 25G, and 25B are made from phosphor layer materials selected from a group consisting of phosphor layer materials for emission of red light, phosphor materials for emission of green light, and phosphor materials for emission of blue light. These phosphor layers 25R, 25G, and 25B are disposed over the address electrodes 22. For example, if the plasma display device of the present invention is configured as a color display device, the phosphor layer (red phosphor layer 25R) made from a phosphor layer material for emission of red light is provided over one address electrode 22; the phosphor layer (green phosphor layer 25G) made from a phosphor layer material for emission of green light is provided over another address electrode 22; and the phosphor layer (blue phosphor layer 25B) made from a phosphor layer material for emission of blue light is provided over a further address electrode 22. These phosphor layers 25R, 25G, and 25B are grouped into one set, and in actual, a plurality of the sets of the phosphor layers are provided in a specific order. As described above, the region in which one pair of the discharge sustain electrodes 12 are overlapped to one set of the phosphor layers 25R, 25G, and 25B for emission of light of the three primary colors is equivalent to one pixel P1.

Phosphor layer materials for forming the phosphor layers 25R, 25G, and 25B can be suitably selected from the known phosphor layer materials. Concretely, among the known phosphor layer materials, those being high in quantum efficiency and less in saturation against vacuum ultraviolet rays may be preferably used. If the plasma display device of the present invention is configured as a color display device, it is preferable that a combination of three phosphor layer materials for emission of light of three primary colors is specified such that the three primary colors are close to three primary colors whose purities are specified in NTSC (National TV Standards Committee), a good white balance can be maintained at the time of mixing the three primary colors, and the afterglow times of light emitted from the three phosphor layers are short and are nearly equal to each other.

Such phosphor layer materials are exemplified as follows. Examples of the phosphor layer materials for emission of red light include ($Y_2O_3$: Eu), ($YBO_3$, Eu), ($YVO_4$, Eu), ($Y_{0.96}P_{0.60}V_{0.40}O_4$, $Eu_{0.04}$), [(Y,Gd)$BO_3$: Eu], ($GdBO_3$: Eu), ($ScBO_3$: Eu), and ($3.5MgO.0.5MgF_2.GeO_2$: Mn). Examples of the phosphor layer materials for emission of green light include ($ZnSiO_2$: Mn), ($BaAl_{12}O_{19}$: Mn), ($BaMg_2Al_{16}O_{27}$: Mn) ($MgGa_2O_4$: Mn), ($YBO_3$: Tb), ($LuBO_3$: Tb), and ($Sr_4Si_3O_8Cl_4$: Eu). Example of the phosphor layer materials for emission of blue light include ($Y_2SiO_5$: Ce), ($CaWO_4$: Pb), $CaWO_4$, $YP_{0.85}V_{0.15}O_4$, ($BaMgAl_{14}O_{23}$: Eu), ($Sr_2P_2O_7$: Eu), and ($Sr_2P_2O_7$: Sn).

The phosphor layers 25R, 25G and 25B can be formed in accordance with various methods. Examples of these methods include a method of forming thick phosphor layers by printing, a method of forming phosphor layers by spraying phosphor particles, a method of forming phosphor layers by previously sticking an adhesive material on phosphor layer formation regions and sticking phosphor particles to the adhesive material, a method of forming phosphor layers by forming a layer of photosensitive phosphor paste and patterning the layer by exposure and development, and a method of forming phosphor layers by forming a phosphor layer over the surface and removing unnecessary regions by sand blasting.

The phosphor layers 25R, 25G and 25B may be directly formed on the address electrodes 22, or may be formed on the address electrodes 22 so as to cover side wall surfaces of the barrier ribs 24. Alternatively, the phosphor layers 25R, 25G and 25B may be formed on the insulating film 23 which has been formed on the address electrodes 22, or may be formed on the insulating film 23 which has been formed on the address electrodes 22 in such a manner as to cover side wall surfaces of the barrier ribs 24. Further, the phosphor layers 25R, 25G and 25B may be formed only on the side wall surfaces of the barrier ribs 24. The insulating film 23 may be made from a low melting point glass or $SiO_2$.

According to this embodiment, as shown in FIGS. 1 to 3, the barrier ribs 24 are formed in a waffle pattern as a whole. To be more specific, the barrier ribs 24 have a plurality of vertical ribs 24*a* extending in the second direction Y while being nearly in parallel to each other, and a plurality of lateral ribs 24*b* extending in the first direction X while being nearly in parallel to each other. As shown in FIG. 1, each of the vertical ribs 24*a* extends nearly in parallel to the address electrodes 22 while being located between adjacent two of the address electrodes 22. The lateral rib 24*b* is integrated with the vertical rib 24*a* and has the same height as that of the vertical rib 24*a*. As shown in FIGS. 2 and 3, each lateral rib 24*b* is located at a position corresponding to a between-pixel gap present between one pair of the discharge sustain electrodes 12 of one pixel and another pair of the discharge sustain electrodes 12 of the adjacent pixel. In other words, each lateral rib 24*b* is formed between the two bus electrodes 13 pertaining to the adjacent pixels in the second direction Y.

According to this embodiment, each lateral rib 24*b* is composed of two rows of rib elements. Each rib element has a notch 26 that is located between the vertical ribs 24*a*. Such a notch 26 is adapted to communicate the adjacent pixels to each other in the second direction. As shown in FIG. 3, the notches 26 formed in the adjacent rib elements (multi-row ribs) of one lateral rib 24*b* are located at the same position as seen in the second direction Y; however, the notches 26 formed in the adjacent rib elements of the adjacent lateral rib 24*b* apart from the one lateral rib 24*b* with the discharge sustain electrodes 12 put therebetween are located at a position offset from that of the notches 26 formed in the adjacent rib elements of the one lateral rib 24*b* as seen in the second direction Y. For example, with attention taken on one vertical rib 24*a* extending in the direction Y, one lateral rib (multi-row rib) 24*b* is branched leftwardly from one position of the vertical rib 24*a*, and another lateral rib 24*b* is branched rightwardly from the adjacent position of the vertical rib 24*a* in the second direction Y, wherein the leading ends of the two rib elements of each lateral rib 24*b* are not joined to the adjacent vertical rib 24*a* but are provided with the notches 26.

According to this embodiment, as shown in FIG. 2, a reflection preventing groove 24*c* is formed between the two rows of rib elements of the lateral rib 24*b*. External light, which has entered from the display screen side into the reflection preventing groove 24*c*, is repeatedly reflected between side walls of the reflection preventing groove 24*c*, to be decayed, whereby such less light emerges out of the display screen side. The bottom of the reflection preventing groove 24*c* may reach the insulating film 23 but may be short of the insulating film 23.

The total width W3 of the lateral rib 24*b* composed of the two rows of rib elements may be in a range of 1 to 6 times, preferably, 4 to 6 times the width W4 of the vertical rib 24*a*, and as shown in FIG. 2, it may be in a range of 0.7 to 2.0 times the width W2 of the between-pixel gap.

According to this embodiment, the width W5 of each lateral rib element is set to be nearly equal to the width W4 of the vertical rib 24*a*. The width W4 of the vertical rib 24*a* is not particularly limited but is typically in a range of about 30 to 60 $\mu$m. The width W6 of the reflection preventing film 24*c* in the second direction is set to a value obtained by subtracting the double of the width W5 from the total width W3.

According to this embodiment, the width W7 of each notch 26 in the first direction (see FIG. 3) is in a range of ½ to 1 time of the width W4 of the vertical rib 24*a* of the barrier rib 24, and more specifically, in a range of about 30 to 50 $\mu$m. The depth of each notch 26 is equal to the height of the barrier rib 24.

The barrier rib 24 having the above-described pattern may be made from a known insulating material, for example, a widely used insulating material such as a mixture of low melting point glass and a metal oxide such as alumina. The height of the barrier rib 24 is in a range of 50 to 200 $\mu$m. The arrangement pitch of the vertical ribs 24*a* of the barrier ribs 24 is in a range of about 50 to 400 $\mu$m. The arrangement pitch of the lateral ribs 24*b* of the barrier ribs 24 is as large as about three times the pitch of the vertical ribs 24*a*.

According to this embodiment, the whole of the barrier ribs 24 may have a black color or a color similar thereto, to form a so-called black matrix, thereby further enhancing the contrast of a display screen. The blackening of the barrier ribs 24 may be performed by a manner of forming the barrier ribs by using a barrier rib material containing a coloring agent which is black or a color similar thereto. The coloring agent of black or a color similar thereto is exemplified by a metal oxide such as ion, manganese, or chromium.

The discharge spaces surrounded by the barrier ribs 24 are filled with a discharge gas composed of a mixed gas. The phosphor layers 25R, 25G, and 25B are irradiated with ultraviolet rays generated by glow discharge generated in the discharge gas in the discharge spaces 4, to emit light.

[Method of producing Plasma Display Device]

A method of producing the plasma display device according to the embodiment of the present invention will be described below.

A first panel 10 can be produced in accordance with the following method. A plurality of pairs of discharge sustain electrodes 12 are formed by forming an ITO layer overall on a first substrate 11 made from high strain point glass or soda glass, for example, by a sputtering process, and patterning the ITO layer into stripe shapes by a photolithography technique and an etching technique. The discharge sustain electrodes extend in the direction X.

Bus electrodes 13 are formed along edges of the discharge sustain electrodes 12 by forming an aluminum film overall on the inner surface of the first substrate 11, for example, by a vapor-deposition process, and patterning the aluminum film by a photolithography technique and an etching technique. A dielectric layer 14 made from silicon oxide ($SiO_2$) is formed overall on the inner surface of the first substrate 11 provided with the bus electrodes 13.

According to this embodiment, the method of forming the dielectric layer 14 is not particularly limited, but may be generally performed, for example, by an electron beam vapor-deposition process, a sputtering process, a vapor-deposition process, or a screen printing process.

A protective layer 15 made from magnesium oxide (MgO) is formed to a thickness of 0.6 $\mu$m by an electron beam vapor-deposition process or a sputtering process. The first panel 10 is thus accomplished.

The second panel 20 can be produced in accordance with the following method. Address electrodes 22 are formed by forming an aluminum film on a second substrate 21 made from high strain point glass or soda glass, for example, by a vapor-deposition process, and patterning the aluminum film by a photolithography technique and an etching technique. The address electrodes 22 extend in the second direction Y perpendicular to the first direction X. An insulating film 23 is formed by forming a low melting point glass paste layer on the overall surface by a screen printing process, and baking the low melting point glass paste layer.

Barrier ribs 24 having the pattern shown in FIGS. 1 to 3 are formed on the insulating film 23. The method of forming the barrier ribs 24 is not particularly limited but may be generally performed by a screen printing process, a sand blasting process, a dry film process, or a sensitizing process. The dry film process involves laminating a photosensitive film on a substrate, removing portions, in barrier rib formation regions, of the photosensitive film by exposure and development, burying the opening portions formed in the removing step with a material for forming the barrier ribs, and baking the material. In this process, the photosensitive film is removed by burning in the baking step, and the material for forming the barrier ribs buried in the opening portions remain as barrier ribs 24. The sensitizing process involves forming a layer made from a material for forming barrier ribs on a substrate, patterning the material layer by exposure and development, and baking the material layer.

The baking (barrier rib baking step) is performed in air, wherein the baking temperature is set to about 500° C. and the baking time is set to about 2 hr.

Slurries for forming phosphor layers of three primary colors are each printed between the barrier ribs 24 formed on the second substrate 21 in the order of the three primary colors. The second substrate 21 is then baked in a baking furnace, to form each of the phosphor layers 25R, 25G, and 25B between the barrier ribs 24 in such a manner as to cover the insulating film between the barrier ribs 24 and side wall surfaces of the barrier ribs 24. In this baking (phosphor baking step), the baking temperature is set to about 510° C., and the baking time is set to about 10 min.

The above-described first panel 10 and the second panel 20 are assembled into a plasma display device as follows. A seal layer is formed at a peripheral edge portion of the second panel 20, for example, by a screen printing process, and then the first panel 10 is stuck on the second panel 20, to be baked for curing the seal layer. The space between the first panel 10 and the second panel 20 is evacuated and filled with a discharge gas, and then the space is sealed. A plasma display device 2 is thus accomplished.

One example of an AC glow discharge operation of the plasma display device having such a configuration will be described below. A panel voltage higher than a discharge starting voltage Vbd is applied to all of the one-sided discharge sustain electrodes 12 of the pairs of the discharge sustain electrodes 12 for a short period of time, to generate glow discharge. Accordingly, electric charges of the opposed polarities adhere on portions, near all of the both-sided discharge sustain electrodes 12 of the pairs of the discharge sustain electrodes 12, of the surface of the dielectric layer 14. In this way, wall electric charges are stored, to lower an apparent discharge starting voltage. A voltage is applied to those, pertaining to discharge cells not required to be operated for display, of the one-sided discharge sustain electrodes 12 while a voltage is applied to one address electrode 22, to generate glow discharge between the address electrode 22 and the associated one-sided discharge sustain electrodes 12, thereby erasing the stored wall electric charges. Such erasing discharge is sequentially performed for each of the address electrodes 22. On the other hand, no voltage is applied to those, pertaining to discharge cells required to be operated for display, of the one-sided discharge sustain electrodes, to keep the stored wall electric charges. A specific pulse voltage is then applied between each of all of the pairs of discharge sustain electrodes 12. As a result, at the cells in which the wall electric charges remain as stored, glow discharge starts between each of the pairs of the discharge sustain electrodes 12, so that the phosphor layers are excited by irradiation with vacuum ultraviolet rays generated on the basis of the glow discharge in the discharge gas in the discharge spaces, to emit light of colors inherent to the phosphor layer materials. In addition, the phases of the discharge sustain voltages applied to the one-sided discharge sustain electrodes and the other-sided discharge sustain electrodes are offset from each other by a half period, and thereby the polarities of the electrodes are reversed in accordance with the frequency of the alternating current.

According to the plasma display device 2 in this embodiment, since the lateral rib 24*b* is composed of the two or more rows of lateral rib elements, the contrast can be improved as compared with the related art plasma display device configured such that each of the vertical rib and the lateral rib is composed of the one row of rib element.

Since the reflection preventing groove 24*c* is formed between the lateral rib elements 24*b*, external light having entered in the reflection preventing groove 24*c* less emerges out of the display screen, with a result that the contrast of external light can be further improved.

According to the plasma display device in this embodiment, since the lateral rib 24*b* has the notches 26 between the vertical ribs 24*a*, there can be obtained an advantage that at the time of forming the phosphor layers 25R, 25G, and 25B by printing, the phosphor paste having been dropped on the bottom of a space surrounded by the barrier ribs 24 can be moved between the adjacent pixels through the notches 26. As a result, it is possible to facilitate the printing performed by dropping phosphor paste on the bottom of the space surrounded by the barrier ribs 24, and hence to reduce a variation in applied amount of the phosphor.

(Second Embodiment)

Figure 4:
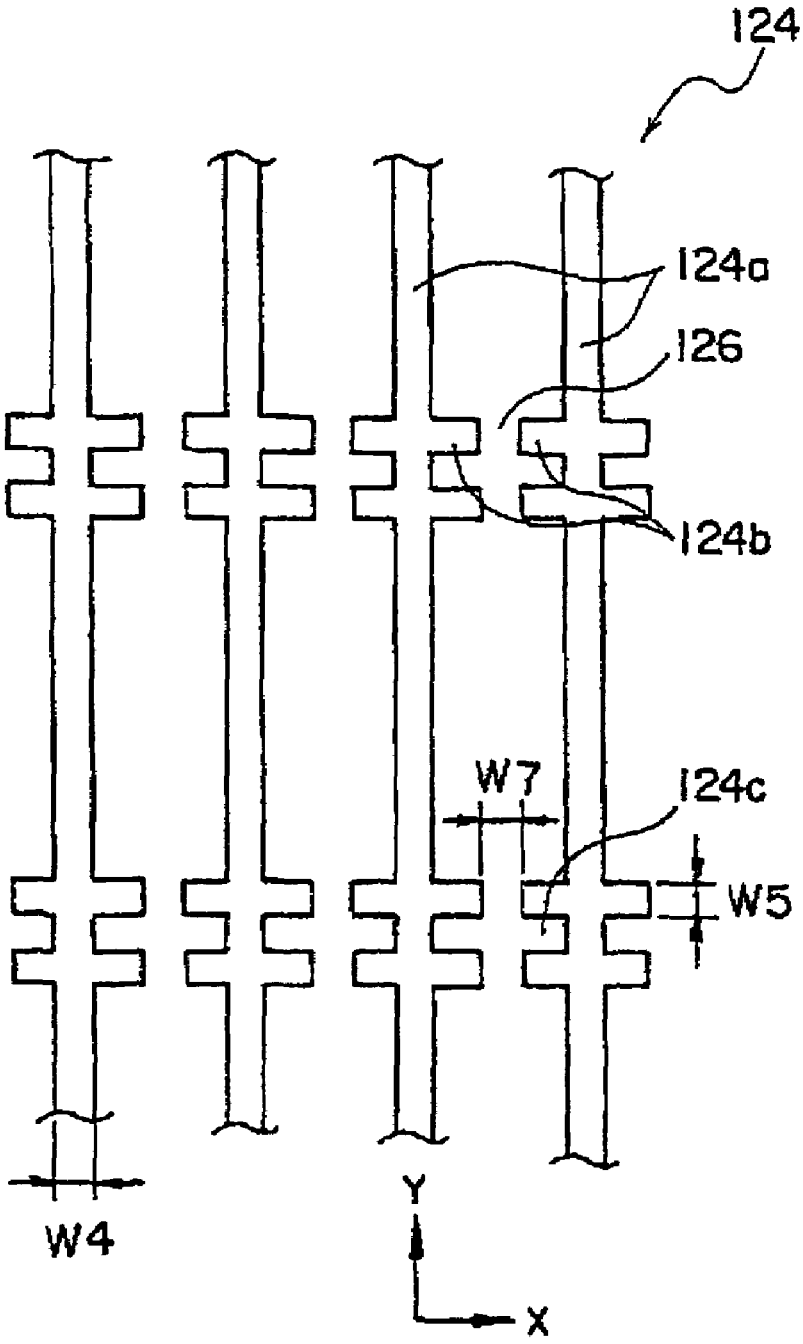
FIG. 4 is a plan view showing a pattern of barrier ribs according to another embodiment of the present invention.

A plasma display device according to this embodiment is modified from the plasma display device 2 shown in FIGS. 1 to 3, and is different therefrom in positions of notches 126 formed in a lateral rib 124*b* composed of two rows of lateral rib elements as shown in FIG. 4. In the following description, parts shown in FIG. 4, which are common to those of the first embodiment, are denoted by reference numerals common to those of the common parts of the first embodiment, and only different points will be described, with the overlapped description of the common parts omitted.

In a pattern of barrier ribs 124 shown in FIG. 4, notches 126 formed in lateral ribs 124*b* branched from each vertical rib 124*a* are located at the same position in a central portion between the vertical ribs 124*a*, as viewed along the second direction Y.

This embodiment exhibits the same function and effect as those of the first embodiment.

(Third Embodiment)

Figure 5:
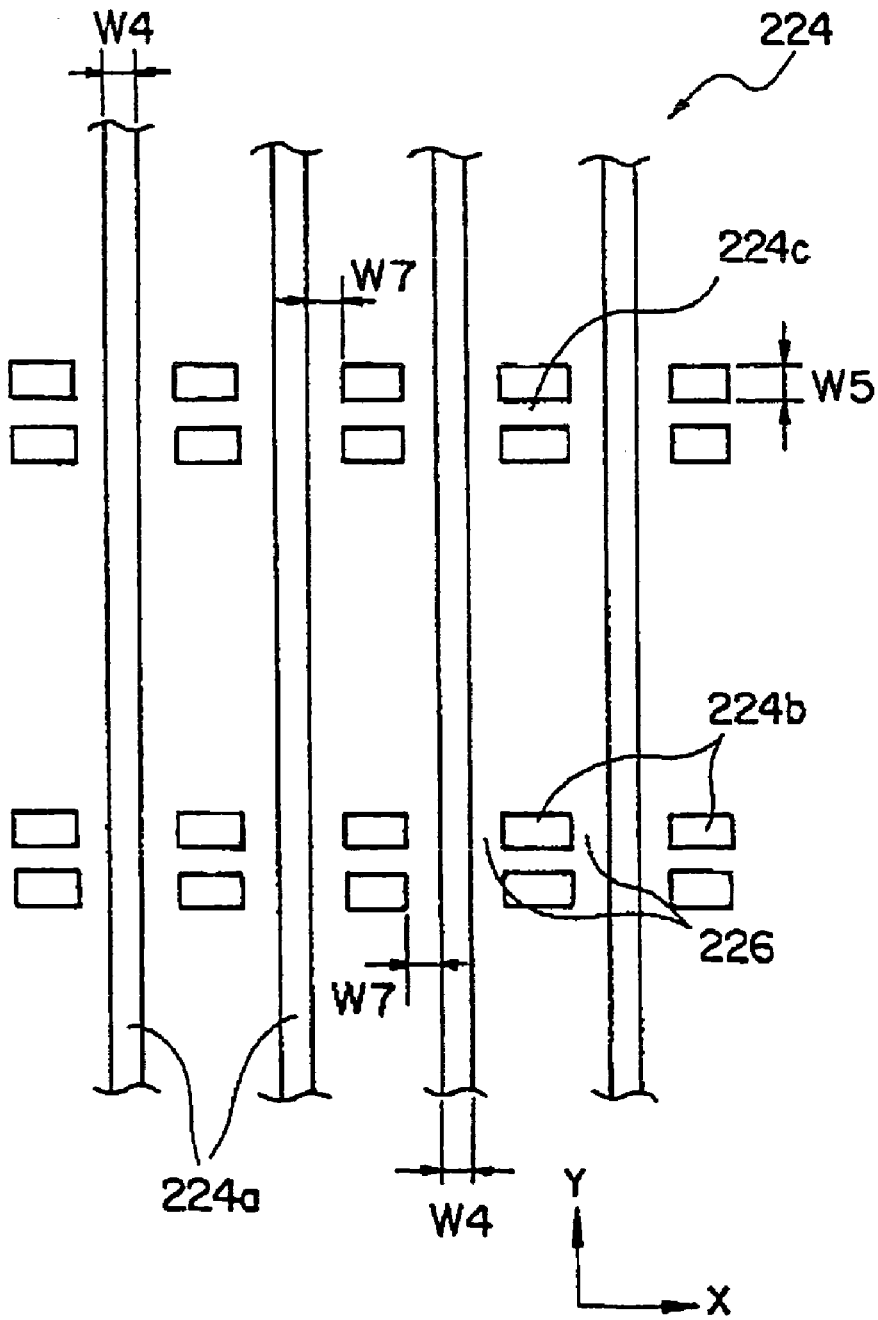
FIG. 5 is a plan view showing a pattern of barrier ribs according to a further embodiment of the present invention.

A plasma display device according to this embodiment is modified from the plasma display device 2 shown in FIGS. 1 to 3, and is different therefrom in positions of notches 226 formed in a lateral rib 224*b* composed of two rows of lateral rib elements as shown in FIG. 5. In the following description, parts shown in FIG. 5, which are common to those of the first embodiment, are denoted by reference numerals common to those of the common parts of the first embodiment, and only different points will be described, with the overlapped description of the common parts omitted.

In a pattern of barrier ribs 224 shown in FIG. 5, notches 226 formed in lateral ribs 224*b*, each of which is composed of two rows of rib elements, are located at the same position on each of both sides of each lateral rib 224*b*, as viewed along the second direction Y. In other words, in the barrier ribs 224 shown in FIG. 5, the lateral ribs 224*b* are formed between the vertical ribs 224*a* and are not joined to the vertical ribs 224*a*.

This embodiment exhibits the same function and effect as those of the first embodiment.

(Fourth Embodiment)

Figure 6:
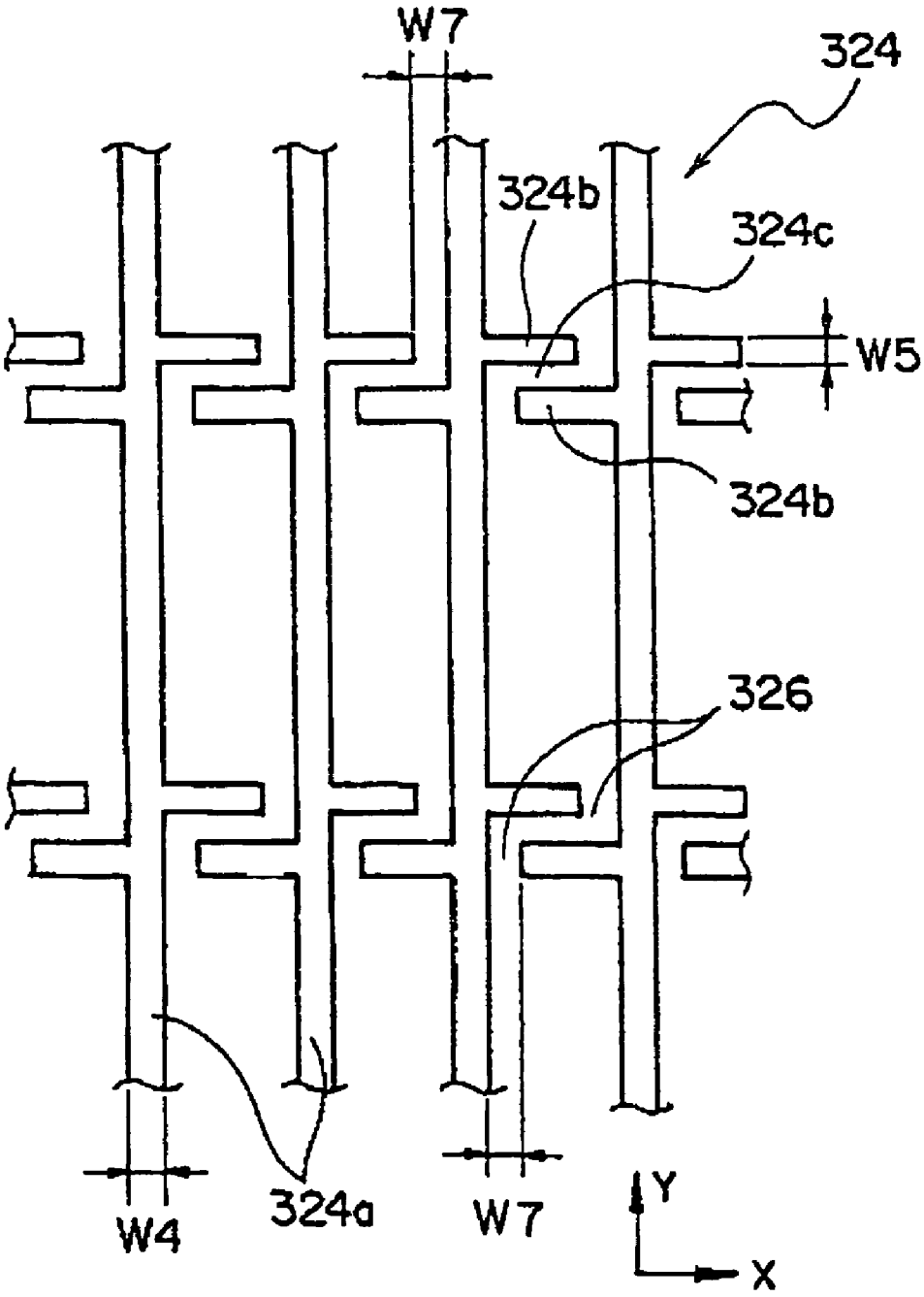
FIG. 6 is a plan view showing a pattern of barrier ribs according to a further embodiment of the present invention.

A plasma display device according to this embodiment is modified from the plasma display device 2 shown in FIGS. 1 to 3, and is different therefrom in positions of notches 326 formed in a lateral rib 324*b* composed of two rows of lateral rib elements as shown in FIG. 6. In the following description, parts shown in FIG. 6, which are common to those of the first embodiment, are denoted by reference numerals common to those of the common parts of the first embodiment, and only different points will be described, with the overlapped description of the common parts omitted.

In a pattern of barrier ribs 324 shown in FIG. 6, notches 326 are formed in lateral ribs 324*b*, each of which is composed of two rows of rib elements, at positions where the notches 326 are not continuous but staggered between the adjacent rib elements as viewed along the second direction Y. In other words, the lateral ribs 324 form a labyrinth shape in a plan view.

This embodiment exhibits the same function and effect as those of the first embodiment, and has another effect of preventing crosstalks between discharge spaces in the direction Y and ensuring good flowability of phosphor paint.

(Fifth Embodiment)

Figure 7:
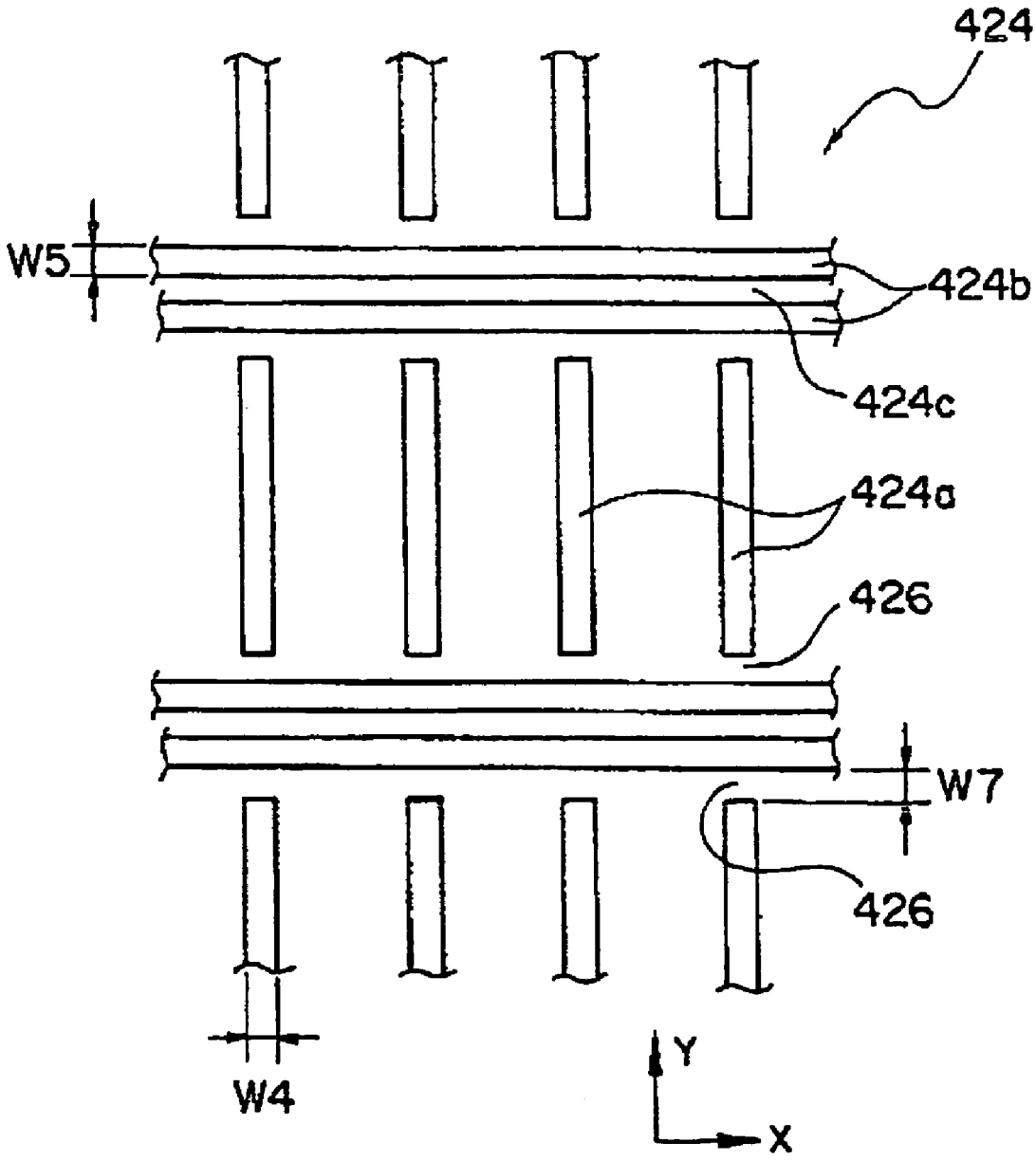
FIG. 7 is a plan view showing a pattern of barrier ribs according to a further embodiment of the present invention.

A plasma display device according to this embodiment is modified from the plasma display device 2 shown in FIGS. 1 to 3, and is different therefrom in that as shown in FIG. 7, each lateral rib 424*b* composed of two rows of lateral rib elements has no notch and is formed into a stripe shape, and each vertical rib 424*a* has notches 426. In the following description, parts shown in FIG. 7, which are common to those of the first embodiment, are denoted by reference numerals common to those of the common parts of the first embodiment, and only different points will be described, with the overlapped description of the common parts omitted.

In a pattern of barrier ribs 424 shown in FIG. 7, each lateral rib 424*b* composed of two rows of rib elements extends in a stripe shape in the first direction X, and a vertical rib 424*a* has notches at a position where it crosses the lateral rib 424*b*. The width W7 of the notch 426 formed in the vertical rib 424*a* in the second direction, which notch extends to the lateral rib 424*b*, is the same as the width W7 of the notch formed in the lateral rib in the second direction described in each of the previous embodiments.

This embodiment exhibits the same function and effect as those of the first embodiment, and has another effect of further improving the contrast of external light as compared with the previous embodiments.

(Sixth Embodiment)

Figure 8:
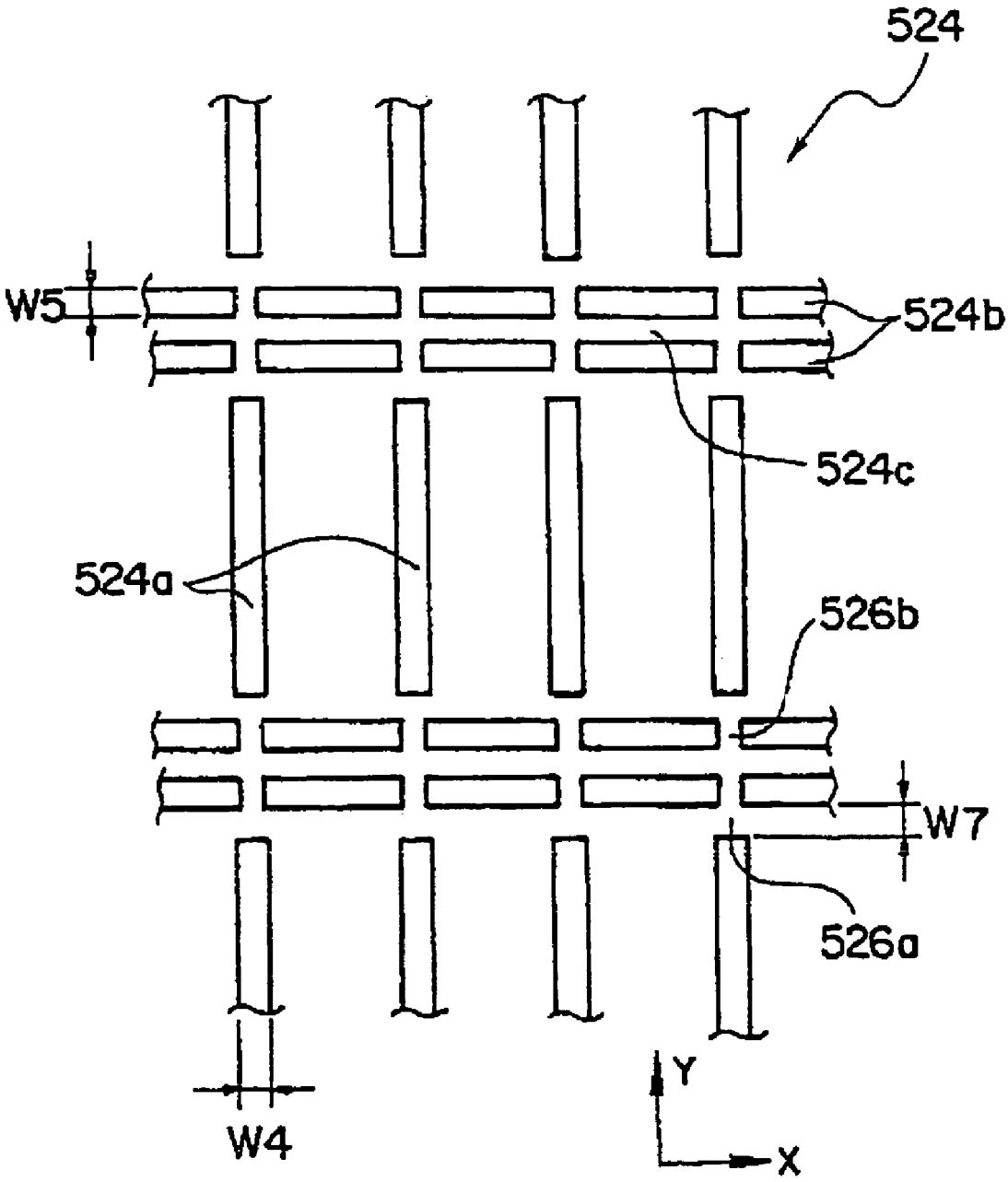
FIG. 8 is a plan view showing a pattern of barrier ribs according to a further embodiment of the present invention.

A plasma display device according to this embodiment is modified from the plasma display device 2 shown in FIGS. 1 to 3, and is different therefrom in positions of notches formed in each lateral rib 524*b* composed of two rows of lateral rib elements as shown in FIG. 8, and is also different therefrom in that each vertical rib 524*a* has notches 526 as shown in FIG. 8. In the following description, parts shown in FIG. 8, which are common to those of the first embodiment, are denoted by reference numerals common to those of the common parts of the first embodiment, and only different points will be described, with the overlapped description of the common parts omitted.

In a pattern of barrier ribs 524 shown in FIG. 8, each lateral rib 524*b* composed of two rows of rib elements has notches 526*b* at a position where it crosses each vertical rib 524*a* in the first direction X, and each vertical rib 524*a* has notches 526 at a position where it crosses each lateral rib 524*b*. The width W7 of the notch 526*a* formed in the vertical rib 524*a* in the second direction, which notch extends to the lateral rib 524*b*, is the same as the width W7 of the notch formed in the lateral rib in the second direction described in the previous embodiments. The width of notch 526*b* formed in the lateral rib 524*b* in the first direction X is the same as the width W7.

This embodiment exhibits the same function and effect as those of the first embodiment, and has another preferable effect of preventing crosstalks in both the direction X and the direction Y.

(Seventh Embodiment)

Figure 9:
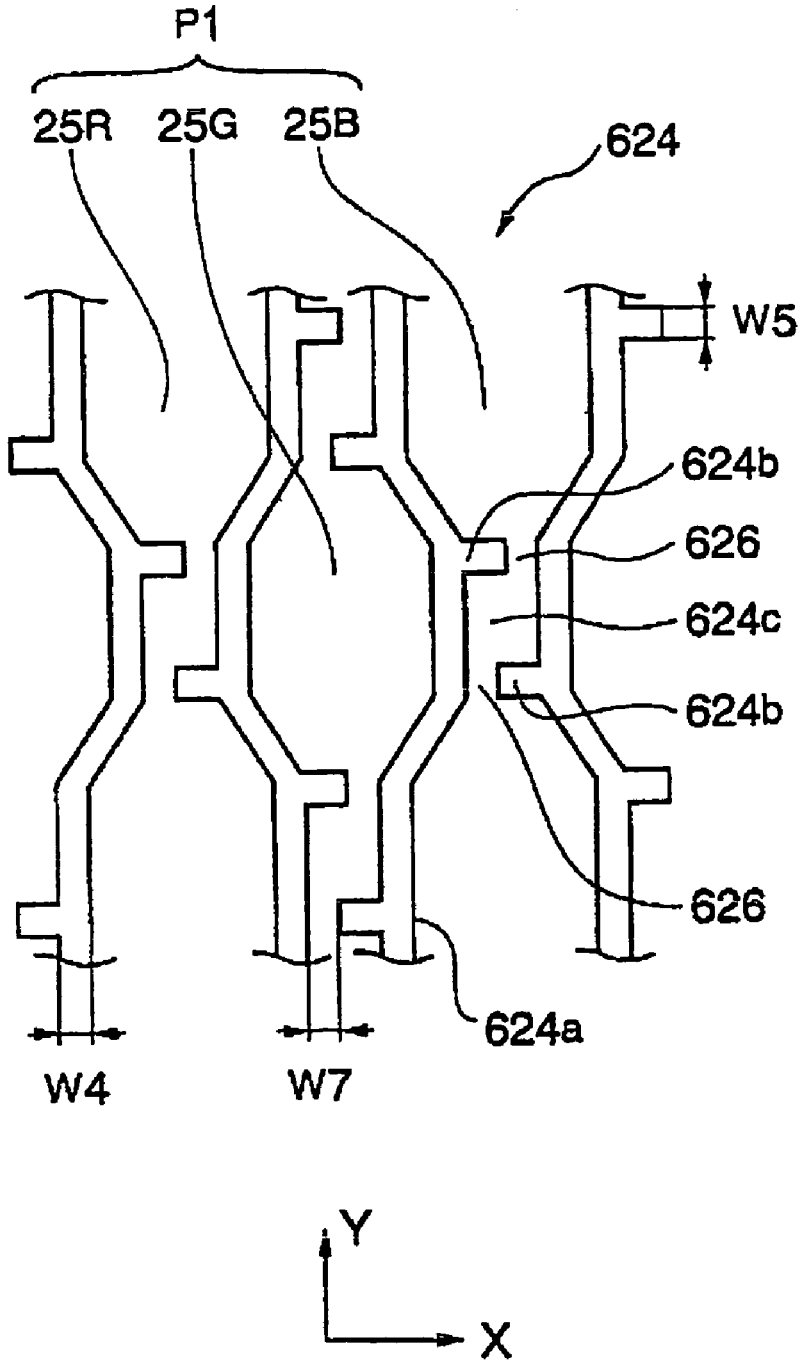
FIG. 9 is a plan view showing a pattern of barrier ribs according to a further embodiment of the present invention.

This embodiment is modified from the plasma display device shown in FIG. 6, and is different therefrom in a pattern of barrier ribs 624 as shown in FIG. 9. In the following description, parts shown in FIG. 9, which are common to those of the first embodiment, are denoted by reference numerals common to those of the common parts of the first embodiment, and only different points will be described, with the overlapped description of the common parts omitted.

In a pattern of barrier ribs 624 shown in FIG. 9, each vertical rib 624*a* is formed into a meandering shape or a zigzag shape (or any other similar shape). A discharge space typically formed into a polygonal shape is disposed between the adjacent vertical ribs 624*a* in such a manner as to extend in a zigzag shape in both the first direction X and the second direction Y. A lateral rib 624*b* is formed at a position where the adjacent vertical ribs 624*a* become closest to each other, that is, the distance therebetween becomes smallest.

Notches 626 are formed in each lateral rib 624*b* composed of two rows of rib elements at positions where they are not continuous but staggered between the adjacent rib elements as viewed along the second direction Y. In other words, the lateral ribs 624*b* form a labyrinth shape in a plan view.

This embodiment exhibits the same function and effect as those of the embodiment shown in FIG. 6, and also exhibits the following function and effect.

Namely, by applying the present invention to the related art special rib structure such as a meandering structure, a waffle structure, or any other structure having vertical ribs extending not in a straight-line shape, it is possible to further increase the strength of barrier ribs and to further reduce crosstalks in the vertical direction and noise.

The double waffle structure in this embodiment is also advantageous in that since each reflection preventing groove 624*c* is formed between the lateral rib elements, it is possible to improve the contrast of external light and to reduce the reflection of external light.

(Other Embodiments)

The present invention is not limited to the above-described embodiments, and may be variously modified within the scope of the present invention.

For example, according to the present invention, the structure of the plasma display device is not limited to that described in each of the embodiments with reference to FIGS. 1 to 9 but may be any other structure within the scope of the present invention.

Hereinafter, the present invention will be more fully described by way of the following examples which, however, should not be construed as limiting the present invention.

EXAMPLE 1

A first panel 10 was produced in accordance with the following method. First, a plurality of pairs of discharge sustain electrodes 12 were formed by forming an ITO layer overall on the surface of a first substrate 11 made from high strain point glass or soda glass, for example, by a sputtering process, and patterning the ITO layer into stripe shapes by a photolithography technique and a etching technique.

Bus electrodes 13 were formed along edges of the discharge sustain electrodes 12 by forming an aluminum film overall on the inner surface of the first substrate 11, for example, by a vapor-deposition process, and patterning the aluminum film by a photolithography technique and an etching technique.

A dielectric layer 14 composed of a silicon oxide ($SiO_2$) layer was formed overall on the surface of the first substrate 11 provided with the bus electrodes 13. The thickness of the silicon oxide ($SiO_2$) layer was set to about 6 $\mu$m.

A protective layer 15 composed of a magnesium oxide (MgO) layer having a thickness of 0.6 $\mu$m was formed on the dielectric layer 14 composed of the silicon oxide layer by an electron beam vapor-deposition process. The first panel 10 was thus accomplished.

A second panel 20 was formed in accordance with the following method. First, address electrodes 22 were formed on a second substrate 21 made from high strain point glass or soda glass. An insulating film 23 was formed by forming a low melting point glass paste layer on the overall surface by a screen printing process, and baking the low melting point glass paste layer.

Low melting point glass paste was printed on the insulating film 23, for example, by a screen printing process. The second substrate 21 was then baked in a baking furnace, to form barrier ribs 24 having the same pattern as that shown in FIG. 7. The baking treatment (barrier rib baking step) was performed in air. The baking temperature was set to about 560° and the baking time was set to about 2 hr.

Slurries for forming phosphor layers of three primary colors were each printed between the barrier ribs 24 formed on the second substrate 21 in the order of the three primary colors. The second substrate 21 was then baked in a baking furnace, to form phosphor layers 25R, 25G, and 25B in such a manner as to cover the insulating film between the barrier ribs and side wall surfaces of the barrier ribs 24. The baking temperature was set to 510° C. and the baking time was set to 10 min. The second panel 20 was thus accomplished.

The first and second panels 10 and 20 were assembled into a plasma display device as follows. First, a seal layer was formed along the peripheral edge of the second panel 20 by a screen printing process. The first panel 10 and the second panel 20 were then stuck on each other and are baked to cure the seal layer. A space formed between the first panel 10 and the second panel 20 was evacuated, and was enclosed with 100% of xenon (Xe) as a discharge gas at a pressure of 30 kPa. The space was then sealed. A plasma display device 2 was thus accomplished.

The plasma display device 2 thus produced was subjected to measurement of contrast of a display screen thereof. The measurement was performed in accordance with the television set testing method specified under JIS C6101-1988.

The ratio of black density, as the evacuation standard of contrast, of the display screen of the plasma display device 2 in this example was 23.7. As the ratio of black density becomes small, the contract becomes higher.

Additionally, in this example, the barrier ribs 24 were colored into black, and the insulating film 23 was transparent. Further, in this example, the discharge gap W1 was set to 20 $\mu$m, the width W2 of the between-pixel gap was set to 224 $\mu$m which was the same as the total width W3 of the lateral rib, and the width W4 of the vertical rib was set to 50 $\mu$m.

COMPARATIVE EXAMPLE 1

A plasma display device was produced in the same manner as that used for Example 1, except that each lateral rib was configured not as the double-row structure but as the single-row structure and the width of the lateral rib was set to 50 $\mu$m which was the same as the width of each vertical rib. The plasma display device thus produced was subjected to the same measurement as that used in Example 1. The ratio of black density, as the evacuation standard of contrast, of the display screen of the plasma display device in this comparative example was 36.7.

[Evaluation]

As is apparent from the comparison of the result of Example 1 with that of Comparative Example 1, the contrast can be improved only by configuring each lateral rib as the double-row structure.

What is claimed is:

1. A plasma display device comprising:

a plurality of pairs of discharge sustain electrodes formed on the inner side of a first substrate in such a manner as to extend along a first direction while being nearly in parallel to each other;

a dielectric layer formed on the inner side of said first substrate in such a manner as to cover said discharge sustain electrodes; and barrier ribs formed on the inner side of a second substrate in such a manner as to form discharge spaces sealed between said first substrate and said second substrate;

wherein said barrier ribs have vertical ribs extending along a second direction different from said first direction while being nearly in parallel to each other, and lateral ribs extending along said first direction while being nearly in parallel to each other;

notches for communicating spaces surrounded by said vertical ribs and said lateral ribs to each other along at least one of said first direction and said second direction are formed at least in portions of at least one of said vertical ribs and said lateral ribs; and each of said lateral ribs is composed of two or more rows of lateral rib elements; and wherein said vertical ribs formed in such a manner as to extend along said second direction while being nearly in parallel to each other extend not in a straight-line shape but in a meandering shape or a zigzag shape along said second direction, and a discharge space is disposed between said vertical ribs adjacent to each other in such a manner as to extend along both said first direction and said second direction;

said lateral rib is formed at a position where the said vertical ribs adjacent to each other become closest to each other;

wherein said discharge sustain electrodes are formed from a transparent conductive material.

2. A plasma display device according to claim 1, wherein a reflection preventing groove is formed between said lateral rib elements adjacent to each other.

3. A plasma display device according to claim 1, wherein said notch is formed in each of said two or more rows of lateral rib elements of said lateral rib.

4. A plasma display device according to claim 3, wherein said notches formed in said lateral rib elements adjacent to each other are located at positions where said notches are not continuous to each other but are offset from each other as seen along said second direction.

5. A plasma display device according to claim 1, wherein the width of said notch in said first direction is in a range of ½ to 1 times the width of said vertical rib of said barrier rib.

6. A plasma display device according to claims 1, wherein said lateral rib is located at a position corresponding to a between-pixel gap present between one pair of said discharge sustain electrodes of one pixel and another pair of said discharge sustain electrodes of the adjacent pixel.

7. A plasma display device according to claims 1, wherein said notch is formed in said vertical rib.

8. A plasma display device according to claims 1, wherein at least the top of said barrier rib has a black color or a color similar thereto.

9. A plasma display device according to claims 1, further comprising:

address electrodes formed on the surface of said second substrate in such a manner as to extend along said second direction while being nearly in parallel to each other; and an insulating film formed on the surface of said second substrate in such a manner as to cover said address electrodes, said insulating film having a black color or a color similar thereto;

wherein said barrier ribs are formed on the surface of said insulating film.

10. A plasma display device according to claim 2, wherein said notch is formed in each of said two or more rows of lateral rib elements of said lateral rib.

11. A plasma display device according to claim 10, wherein said notches formed in said lateral rib elements adjacent to each other are located at positions where said notches are not continuous to each other but are offset from each other as seen along said second direction.

12. A plasma display device according to claim 2, wherein the width of said notch in said first direction is in a range of ½ to 1 times the width of said vertical rib of said barrier rib.

13. A plasma display device according to claim 2, wherein said lateral rib is located at a position corresponding to a between-pixel gap present between one pair of said discharge sustain electrodes of one pixel and another pair of said discharge sustain electrodes of the adjacent pixel.

14. A plasma display device according to claim 2, wherein said notch is formed in said vertical rib.

15. A plasma display device according to claim 2, wherein at least the top of said barrier rib has a black color or a color similar thereto.

16. A plasma display device according to claim 2, further comprising:

address electrodes formed on the surface of said second substrate in such a manner as to extend along said second direction while being nearly in parallel to each other; and an insulating film formed on the surface of said second substrate in such a manner as to cover said address electrodes, said insulating film having a black color or a color similar thereto;

wherein said barrier ribs are formed on the surface of said insulating film.

* * * * *